US008235825B2

(12) United States Patent
French

(10) Patent No.: US 8,235,825 B2
(45) **Date of Patent: *Aug. 7, 2012**

(54) SMART CARD HOLDER FOR AUTOMATED GAMING SYSTEM AND GAMING CARDS

(75) Inventor: John B. B. French, Reno, NV (US)

(73) Assignee: John B. French, Reno, NV (US)

( * ) Notice: Subject to any disclaimer, the term of this patent is extended or adjusted under 35 U.S.C. 154(b) by 1187 days.

This patent is subject to a terminal disclaimer.

(21) Appl. No.: 11/838,230

(22) Filed: Aug. 14, 2007

(65) Prior Publication Data

US 2009/0048026 A1 Feb. 19, 2009

(51) Int. Cl.
*A63F 9/00* (2006.01)

(52) U.S. Cl. ..... 463/47

(58) Field of Classification Search ..... None
See application file for complete search history.

(56) References Cited

U.S. PATENT DOCUMENTS 6,206,292 B1 3/2001 Robertz et al.
6,638,161 B2 * 10/2003 Soltys et al. ..... 463/12
6,951,596 B2 10/2005 Green et al.
6,957,777 B1 10/2005 Huang
6,986,826 B2 1/2006 Dronzek
7,017,799 B2 3/2006 Schwander
7,023,347 B2 4/2006 Arneson et al.
7,055,756 B2 6/2006 Anderson et al.
7,057,562 B2 6/2006 Forster et al.
7,059,518 B2 6/2006 Forster
7,061,382 B2 6/2006 Claessens et al.
7,066,393 B2 6/2006 Stromberg et al.
7,071,826 B2 7/2006 Peterson
7,102,520 B2 9/2006 Liu et al.
7,109,867 B2 9/2006 Forster
7,117,581 B2 10/2006 Arneson et al.
7,135,979 B2 11/2006 Savagian et al.
7,137,000 B2 11/2006 Hohberger et al.
7,151,979 B2 12/2006 Andersen et al.
7,152,803 B2 12/2006 Stromberg
7,154,283 B1 12/2006 Weakley et al.
7,158,033 B2 1/2007 Forster
7,172,130 B2 2/2007 Tsunoda et al.
7,187,293 B2 3/2007 White et al.
7,199,456 B2 4/2007 Krappe et al.
7,212,127 B2 5/2007 Jacober et al.
(Continued)

*Primary Examiner* — Melba Bumgarner
*Assistant Examiner* — Seng H Lim
(74) *Attorney, Agent, or Firm* — Quine Intellectual Property Law Group, P.C.; Stephen J. LeBlanc

(57) ABSTRACT

Methods and systems for intelligent tracking and/or play and/or management of card gaming use an intelligent card distribution or holding device with detectors for determine the value and unique identity of individual cards and for recording card play. In specific embodiments, the system utilizes various types of sensors and electronic circuits and software to scan, track, monitor, compute, and interface with electronic devices, to enable the automatic operation of Casino table games. The system can scan playing cards, scan gaming chips, indicate a players win/loss/draw, increase and or decrease player betting positions. Compute awards to players based on their playing activity, photograph individual players, and transmit player's images to casino security/surveillance departments and or other authorized casino personnel. The system may activate table displays that indicate each player's win/loss/draw of their bets, and or dealers card count, indicate in the game of blackjack when a dealer has blackjack, or any other significant event that occurs such as indicating when a player has a winning/loss/draw on specific card combinations.

18 Claims, 5 Drawing Sheets

U.S. PATENT DOCUMENTS

| | | | | |
|---|---|---|---|---|
| 7,223,320 | B2 | 5/2007 | Arneson et al. | |
| 7,224,280 | B2 | 5/2007 | Ferguson et al. | |
| 2002/0155869 | A1 * | 10/2002 | Soltys et al. | 463/11 |
| 2004/0147327 | A1 * | 7/2004 | Soltys et al. | 463/47 |
| 2004/0195772 | A1 * | 10/2004 | Marlow | 273/292 |
| 2005/0121852 | A1 * | 6/2005 | Soltys et al. | 273/149 P |
| 2008/0070658 | A1 * | 3/2008 | Labgold et al. | 463/11 |
| 2009/0191933 | A1 * | 7/2009 | French | 463/12 |

* cited by examiner

SMART CARD HOLDER FOR AUTOMATED GAMING SYSTEM AND GAMING CARDS

COPYRIGHT NOTICE

Pursuant to 37 C.F.R. 1.71(e), applicant notes that a portion of this disclosure contains material that is subject to and for which is claimed copyright protection (such as, but not limited to, source code listings, screen shots, user interfaces, or user instructions, or any other aspects of this submission for which copyright protection is or may be available in any jurisdiction.). The copyright owner has no objection to the facsimile reproduction by anyone of the patent document or patent disclosure, as it appears in the Patent and Trademark Office patent file or records. All other rights are reserved, and all other reproduction, distribution, creation of derivative works based on the contents, public display, and public performance of the application or any part thereof are prohibited by applicable copyright law.

FIELD OF THE INVENTION

The present invention in various embodiments is directed to business methods and/or logic processing methods and/or related systems to facilitate gaming.

BACKGROUND OF THE INVENTION

The discussion of any work, publications, sales, or activity anywhere in this submission, including in any documents submitted with this application, shall not be taken as an admission that any such work constitutes prior art. The discussion of any activity, work, or publication herein is not an admission that such activity, work, or publication existed or was known in any particular jurisdiction.

Schemes to fraudulently obtain money or credits from casinos or gaming houses by manipulating card play and/or credit devices, such as chips, are known. In one such scheme, a blackjack dealer may arrange with a co-conspirator to allow the co-conspirator to "win" large amounts from the house. Individual players have also devised unlawful schemes enabling them to "win" at various gaming tables including blackjack and craps. Still other schemes involve the theft or misuse or counterfeiting of gaming cards.

Manipulation and counterfeiting of gaming cards and/or gaming chips are one type of fraud that casinos must monitor. (The term "chip" as used herein shall be understood to encompass any type of gaming or casino-accepted currency, such as gaming chips, plaques, or jetons.) As a consequence of various schemes to manipulate playing cards and/or game results, casinos expend considerable time and effort in manually observing players, game operators, and other casino employees in an effort to make certain that all of the games are fairly played and that card holding, card passing or the use of unauthorized or counterfeit cards is kept to a minimum. Such matters as the amount of a player's buy-in, the time played, the average bet of the player, and a player's win-loss record are often tracked. Such techniques are labor intensive and only partially effective.

Radio Frequency Transponders in Gaming Chips

It is known to embed a radio frequency transponder in a gaming chip, and one such construction is shown in U.S. Pat. No. 5,166,502 to Rendleman et al. It is also known to track the flow and history of gaming chips through a casino. U.S. Pat. Nos. 5,735,742 and 5,651,548 to John French describe aspects of a system to monitor and record all gaming chip transactions in a casino. This system is directed to reducing theft and fraud on the casino floor, while also reducing the need for large numbers of pit employees to manually monitor activities at the various gaming tables. In some implementations, a gaming chip, and/or jetons and or plaques have a body and a transponder carried within the body. The transponder is encoded with permanent read-only identification information and further includes a data bank for receiving and maintaining changeable information transmitted thereto from an RF antenna. The changeable information may include a voidable casino security code, so that a chip may easily be voided if fraud is suspected, as well as a transactional history of the chip within the casino.

Many different RFID technologies exist and continue to be developed. One or more of these technologies can be employed according to specific embodiments of the invention based on various design parameters. It would be understood to on of skill in the RFID art how to select and implement RFID components for use in a system according to specific embodiments of the invention. Some information regarding design and implementation of various RFID systems can be found at http(://)transpondernews(.)com and its linked web pages, as well as the references supplied below.

A number of methods are known for incorporating RF transponders in a flat object such as a product label. For example, the following United States Patent references discuss various RFID technologies, including, surface-printable RFID-transponders; flat-silicon RFID transponders; and RFID transponders that have read/write/erase capability. These references are provided as examples of technology that can be used to implement various aspects of the present invention and are intended not to be limiting.

RFID Background

| | Document | Document Title |
|---|---|---|
| 1 | U.S. Pat. No. 7,223,320 | Method and apparatus for expanding a semiconductor wafer |
| 2 | U.S. Pat. No. 7,224,280 | RFID device and method of forming |
| 3 | U.S. Pat. No. 7,212,127 | RFID tag and label |
| 4 | U.S. Pat. No. 7,199,456 | Injection molded product and a method for its manufacture |
| 5 | U.S. Pat. No. 7,187,293 | Singulation of radio frequency identification (RFID) tags for testing and/or programming |
| 6 | U.S. Pat. No. 7,172,130 | Electronic device, rubber product, and methods for manufacturing the same |
| 7 | U.S. Pat. No. 7,158,033 | RFID device with combined reactive coupler |
| 8 | U.S. Pat. No. 7,152,803 | Smart label web and a method for its manufacture |
| 9 | U.S. Pat. No. 7,154,283 | Method of determining performance of RFID devices |
| 10 | U.S. Pat. No. 7,151,979 | System and method for tracking inventory |
| 11 | U.S. Pat. No. 7,135,979 | In-mold radio frequency identification device label |
| 12 | U.S. Pat. No. 7,137,000 | Method and apparatus for article authentication |
| 13 | U.S. Pat. No. 7,117,581 | Method for high volume assembly of radio frequency identification tags |
| 14 | U.S. Pat. No. 7,109,867 | RFID tags with EAS deactivation ability |

-continued

| Document | Document Title |
|---|---|
| 15 U.S. Pat. No. 7,102,520 | RFID device and method of forming |
| 16 U.S. Pat. No. 7,071,826 | Method and devices with a circuit for carrying information on a host |
| 17 U.S. Pat. No. 7,066,393 | Smart label and a smart label web |
| 18 U.S. Pat. No. 7,069,110 | System and method for tracking inventory |
| 19 U.S. Pat. No. 7,059,518 | RFID device detection system and method |
| 20 U.S. Pat. No. 7,061,382 | Apparatus for electronically verifying the authenticity of contents within a container |
| 21 U.S. Pat. No. 7,055,753 | RFID device tester and method |
| 22 U.S. Pat. No. 7,055,756 | Deposition fabrication U.S. Pat. No. ing inkjet technology |
| 23 U.S. Pat. No. 7,057,562 | RFID device with patterned antenna, and method of making |
| 24 U.S. Pat. No. 7,023,347 | Method and system for forming a die frame and for transferring dies therewith |
| 25 U.S. Pat. No. 7,017,799 | Spindle sleeve with transponder |
| 26 U.S. Pat. No. 6,986,826 | Durable supports for labeling and relabeling objects |
| 27 U.S. Pat. No. 6,957,777 | Label to be attached on a plastic product formed in a mold and identifiable by a detecting device |
| 28 U.S. Pat. No. 6,951,596 | RFID label technique |
| 29 U.S. Pat. No. 6,206,292 | Surface-printable RFID-transponders; |

Card Shoes or Card Holders

Various casino-type card games can utilize devices that hold playing cards. Such devices are commonly known as card shoes. Table mounted card shoes can generally be categorized as one of two types: one type holds playing cards, which cards are removed from the card shoe by the card dealer. Typically, such card shoes have only one function and that is to hold playing cards. Another type of card shoe not only holds the playing cards, but also electronically scans playing cards to determine the cards' value. Generally, this scanning is done as the card is leaving the card shoe.

Generally, when using a card shoe, a playing card leaves the shoe with exactly the same data on it, either in printed or electrically or magnetically stored forms, as the card had when it initially entered the shoe. In shoes with electronic scanning, playing cards generally are scanned for a card's suit and value, though generally the cards are not scanned to determine each card's individual uniqueness. Existing card shoes generally are limited in their data exchange ability with playing cards or other game table components.

In some prior systems, playing cards used in table games are scanned by optical devices that are placed within and/or attached to playing card holders. Such scanners scan patterns on or within the playing cards, but these playing cards generally have no capacity to retain or store data during dealing or game play. Playing cards have been developed that have radio frequency transponders therein, but such playing cards generally have no capacity allowing a two way interface with various card holding devices including devices that shuffle playing cards and/or table mounted card scanners.

Some casino table games utilize card holding devices that shuffle playing cards. In some cases, these devices can include scanners integrated within and/or attached thereto to scan the playing cards and to count and verify that no cards are missing and that there are no counterfeit cards within the decks of cards being shuffled. Existing card shuffling machines generally have no features that allow them to erase data, transmit data, record data, and/or write data to the playing cards. Such card shuffling machines generally are not able to individually identify the uniqueness (fingerprint) of each card.

SUMMARY OF THE INVENTION

According to specific embodiments, the present invention is involved with business methods and/or logic processing methods and/or systems and/or devices that can be used together or independently to provide a variety of different services and/or experiences related to gaming, particularly gaming using playing cards or similar game pieces. In further embodiments, the invention can be understood as involved with systems and methods that can be used by a gaming provider to reduce costs and/or provide a more secure and reliable gaming experience and/or prevent fraud.

Playing Cards

The present invention, in various embodiments, is involved with casino gaming systems and methods. According to specific embodiments of the invention, a gaming system has a two-way data interfacing (e.g., read/write or transmit/receive) with playing cards at a gaming table. Playing cards according to specific embodiments of the invention can store data written or transmitted to them by one or more components of the system. This aspect allows monitoring and recording of card play and other innovations related to such monitoring as discussed herein, to improve the overall play of games in a casino environment.

The present invention is also involved with a system that uses or assigns individual unique identifications to each card at a gaming table, and optionally also to each card in a casino. In general, present table game playing cards have no individual finger prints, e.g., a four of diamonds from one deck of cards is not registered in a table card scanner as being different from a four of diamonds from another deck of playing cards. The lack of individual fingerprints for each playing card allows players to fraudulently exchange playing cards, and limits the details that can be recorded in casino table game databanks. According to specific embodiments, the present invention involves one or more methods, devices, and systems that allow unique identification of individual playing cards (e.g., unique identification of multiple cards having the same suit and value) at a gaming table and/or in a casino. The identification of individual playing cards according to specific embodiments allows a gaming provider to track and facilitate game play, reduce disputes regarding the history of a game, and/or reduce various types of fraud and/or mistakes.

Card Holders

A number of different card holders or shuffling machines are known in the art. Some of these holders are generally hand-held during game play and some are generally table-mounted or table-attached during game play. Some holders include an interface for scanning cards leaving the holders, though these are generally not hand-held systems. Generally, prior card holders do not include effective means for writing data to playing cards and subsequently reading that data. Prior card holders also generally do not electronically interface with other significant components related to the table game.

In particular embodiments, the invention involves a playing card holding and/or dealing device that has optical and/or electronic components for communicating data with playing cards and optionally with other components as discussed below. Such holding and/or dealing devices may be of many different configurations, including a table-mounted device that a dealer uses to assist in distributing cards or a hand-held card holder (HHCH) that a dealer uses to distribute cards. While such devices may be known by various terms, in the present description the term "shoe" or "holder" will be used to indicate any device that is used in dealing or distributing playing cards during game play.

In specific embodiments, the present invention involves a card holder that can write data to gaming cards and read that data or other data from the gaming cards. In further embodiments, the invention involves a card holder that includes one or more data interfaces to other electronic components at a gaming table, where such interfaces may be hard wired in some cases or, more preferably, wireless. Example devices to which a card holder according to specific embodiments of the invention may interface include one or more of: (1) gaming chips, (2) a dealer display, (3) a player display, (4) a player request input device, (5) a game play databank, (6) a win/loss calculator and databank, (7) under-table or in-table antennas; (8) other table motion detection devices, (9) a camera, and other devices that are described herein and may also include additional interfaces or devices. Not all implementations of a card holder according to specific embodiments of the invention will interface with each type of example device devices.

Generally, card holding devices that are held in the dealers hand are simple containers that hold playing cards that are dispensed by hand to game participants, e.g., both players and dealer. While aspects of the present invention may be embodied in table-mounted card-holders, in other embodiments the invention preferably involves a hand-held card holder with one or more data interfacing capabilities as described herein. In some instances, such a card holder is referred to herein as an intelligent or smart card holder.

A smart card holder according to specific embodiments of the invention contains logic circuitry to perform various logic processing tasks, at least one sensor or input means to receive external data, and at least one output means to transfer data. According to specific embodiments of the invention, it has been deemed desirable to include in a card holder, multiple functions related to automated gaming play and/or game tracking. Thus a smart holder according to the invention will have incorporated into it one or more of: (1) a power supply; (2) cameras and/or optical scanners; (3) magnetic read/write heads; (4) transponders/antennas for sending and receiving wireless data; (5) digital logic circuitry including a digital memory for processing received data and storing data related to card games; (6) a mechanical door or hinge that can be electronically activated to control card deal.

According to the invention, it has been found that many functions related to game tracking and/or automation are advantageously located on a card holder, particularly a hand-held card holder. For example, because the card holder is very close to game players, a camera embedded in the card holder can get a better photograph of faces of game players to assist in player tracking or identification. Smart card holders according to specific embodiments of the invention can also be used to scan bets and bet positions related to the card game, to identify or scan players and their table positions, and also to interface with objects and markings attached or adjacent to the card table. In some implementations, a casino may use a Hand Held Card Holder (HHCH) for scanning gaming chips and not playing cards. Such implementations may arise for example if table card shoes that only read playing cards are already a part of casino operations. Such implementations may also arise in implementations where a table card shoe may hold as many as 8 or more decks of cards or situations where software for existing shoes is already in use. In this implementations, a HHCH according to the invention may be preferable to other systems because it can be used without modification of a gaming table and has a degree of portability.

In further embodiments, where a casino already has under the table antenna that interface with gaming chips, an HHCH according to specific embodiments of the invention may exchange data with in-table, or under-the-table antenna chip interfacing systems, as described in the above reference.

Software Implementations

Various embodiments of the present invention provide methods and/or systems for gaming facilitation that can be implemented on a general purpose or special purpose information handling appliance using a suitable programming language such as Java, C++, Cobol, C, C#, Pascal, Fortran., PL1, LISP, assembly, etc., and any suitable data or formatting specifications, such as HTML, JSP, XML, dHTML, TIFF, JPEG, tab-delimited text, binary, etc. In further embodiments, any known wireless or over wire transmission protocol can be used to connect various components of the system, including WiFi, Bluetooth, Ethernet, RFID, etc. In the interest of clarity, not all features of an actual implementation are described in this specification. It will be understood that in the development of any such actual implementation (as in any software development project), numerous implementation-specific decisions must be made to achieve the developers' specific goals and subgoals, such as compliance with system-related and/or business-related constraints, which will vary from one implementation to another. Moreover, it will be appreciated that such a development effort might be complex and time-consuming, but would nevertheless be a routine undertaking of software engineering for those of ordinary skill having the benefit of this disclosure.

Other Features & Benefits

In further embodiments, the invention is capable of identifying players, dealers, and associated casino employees that are involved in the activity of casino table games, which increases table game security, and reduces labor costs. In further embodiments, the invention also records the time and details of any significant events that take place related to table game games. The invention identifies and totalizes the value of gaming chips, identifies players that used said identified gaming chips, and correlates the gaming chip bets with identified playing cards that were dealt to specific players, and determines whether that player won/lost/draw on each round of card play. The invention creates an efficient accounting system for monitoring gaming activity on a casino table. In specific embodiments, the electronic components within and or attached to the HHCH can reads gaming chips directly and/or indirectly, and identifies the players that placed the gaming chips in specific betting areas.

The invention and various specific aspects and embodiments will be better understood with reference to the following drawings and detailed descriptions. For purposes of clarity, this discussion refers to devices, methods, and concepts in terms of specific examples. However, the invention and aspects thereof may have applications to a variety of types of devices and systems. It is therefore intended that the invention not be limited except as provided in the attached claims and equivalents.

Furthermore, it is well known in the art that systems and methods such as described herein can include a variety of different components and different functions in a modular fashion. Different embodiments of the invention can include different mixtures of elements and functions and may group various functions as parts of various elements. For purposes of clarity, the invention is described in terms of systems that include many different innovative components and innovative combinations of innovative components and known components. No inference should be taken to limit the invention to combinations containing all of the innovative components listed in any illustrative embodiment in this specification.

In some of the drawings and detailed descriptions below, the present invention is described in terms of the important independent embodiment of a system operating on particular digital data systems. This should not be taken to limit the invention, which, using the teachings provided herein, can be implemented on a variety of different digital systems.

All references, publications, patents, and patent applications cited herein are hereby and cited in any accompanying Information Disclosure Statement are incorporated by reference in their entirety for all purposes.

DESCRIPTION OF PREFERRED EMBODIMENTS

1. Overview

Figure 1:
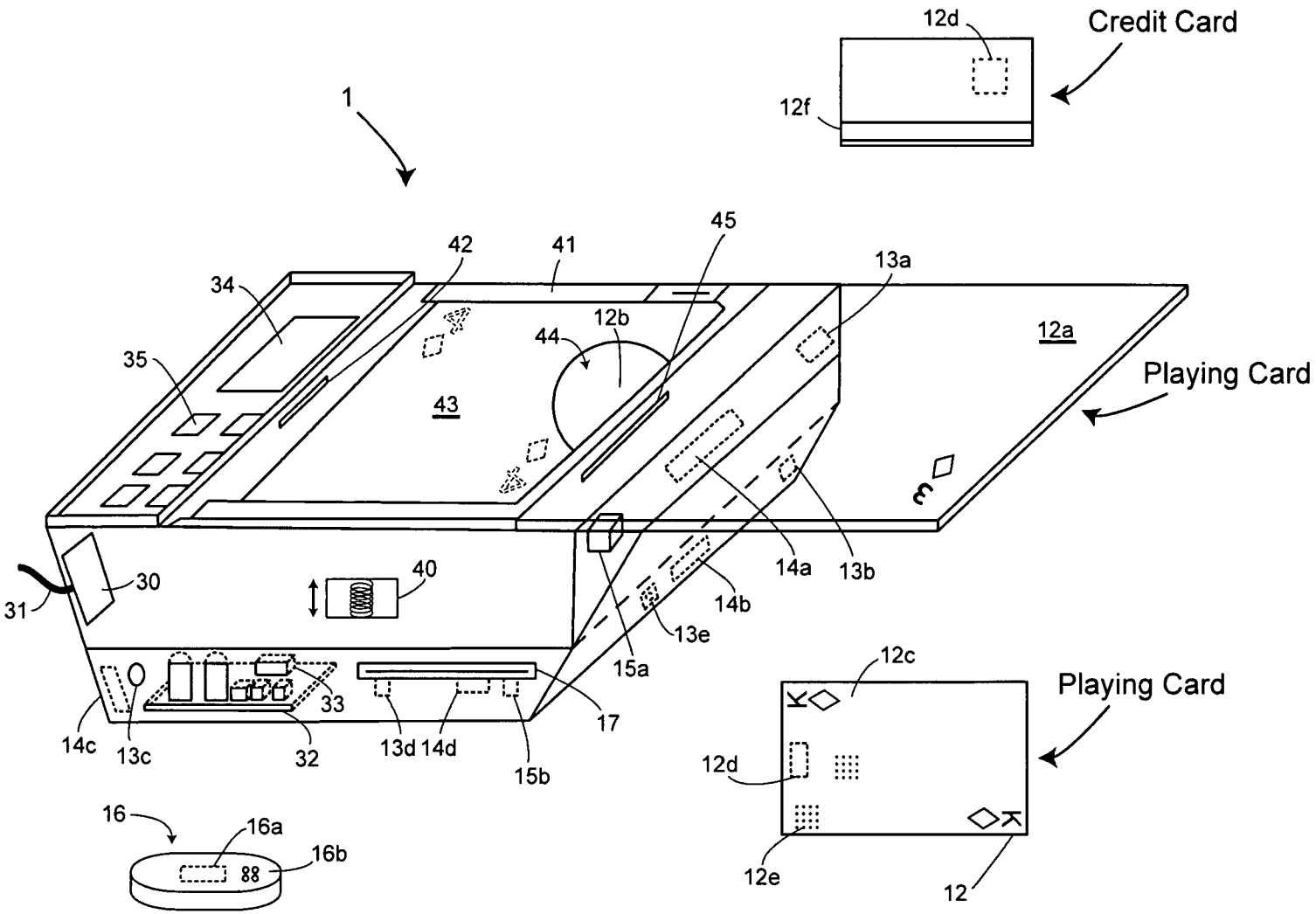
FIG. 1 illustrate an example embodiment of a hand-held smart card holder according to specific embodiments of the invention including a number of optional components.

Before describing the details of specific example implementations, various embodiments, aspects, and advantages of the invention are described below. In this description, it should be understood that while some features are described specifically as related to a Hand Held Playing Card Holder (HHCH), these features may also be present in specific embodiments that use a table playing card holder, which may be understood herein as any card holder or dealing device that generally remains on or adjacent to a gaming table and is generally or never held in a dealers hand above the table during game play.

Furthermore, before describing the present invention in detail, it is to be understood that this invention is not limited to particular compositions or systems, which can, of course, vary. It is also to be understood that the terminology used herein is for the purpose of describing particular embodiments only, and is not intended to be limiting. As used in this specification and the appended claims, the singular forms "a", "an" and "the" include plural referents unless the content and context clearly dictates otherwise. Thus, for example, reference to "a device" includes a combination of two or more such devices, and the like.

Unless defined otherwise, various terms relating to gaming and/or electronic systems used herein have meanings as commonly understood by one of ordinary skill in the art to which the invention pertains. Although any systems and devices similar or equivalent to those described herein can be used in practice or for testing of the present invention, preferred embodiments are described herein.

The present invention is involved with methods and/or systems that facilitate card gaming. In one embodiment, the invention involves playing cards from which data can be read or written and/or that have a unique identifier. In further embodiments, the invention involves a card holder with apparatus that can read and/or write to playing cards and optionally interface with one or more other gaming components. Monitoring software or logic routines executing on a logic processor within or connected to the card holder accomplish various game and/or player tracking features and other automatic gaming operations, as discussed below.

In further embodiments, a card holder of the invention interfaces with gaming chips that have radio frequency circuits (e.g., RFID or transponders) embedded within or attached thereto. In specific embodiments, a card holder of the invention can perform multiple automation tasks as described below without additional modification to a game table, though in other embodiments the card holder can interact with game table optical marks or triggers and/or game table electronics/transponders. Thus the invention involves an intelligent card holding device that incorporates a variety of data sensing and transmission technologies that have not previously been incorporated with a card holder, creating a useful and economic system to automate or enhance game play at various casino table games.

Electronic Interfaces

According to specific embodiments of the invention, a card holder contains at least one type of data interface to exchange data with other elements in the systems. In specific embodiments, a system of the invention utilizes various types of electronic interfaces between a card holder, playing cards, gaming chips, bet positions, dealer chip trays, players, card dealers, casino data banks. In other aspects, embodiments of the system can include various optional components to automate casino table games, such as devices to automate player card requests for receiving and/or rejecting delivery of another playing card. Embodiments of the invention can monitor player's game activity to determine what complimentary gifts they are warranted to receive. The invention can also include sensors and logic or to determine if players are using unwelcome playing strategies. In further embodiments, the invention can total and display players' and/or dealers' card counts and significant events related to those card counts, such as detecting and announcing when the card dealer has blackjack. A system of the invention can also correlate bets (gaming chips) to playing cards and calculate win/loss/draw on such bets. A card holder of the invention can also incorporate or interface with one or more cameras to photograph players at a gaming table.

A card holder of the invention may be custom programmed to function with individual and various types of table games that may have various forms of interactive components that interface with the card holder. Such versatility creates an economic plus for a casino. A card holder of the invention may interface directly and or indirectly with computer systems that wish to receive and or transmit data with the card holder. Such interfacing provide data exchange with various data banks related to a casino environment, such as security, credit, advertising, accounting, etc.

In further embodiments, a system of the invention utilizes various types of sensors and electronic circuits and software to scan, track, monitor, compute, and interface with electronic devices and thereby to enable the automatic operation of various aspects of casino table games. In various embodiments, the system can scan playing cards, scan gaming chips, indicate players' and/or dealers' win/loss/draw status, increase and or decrease player betting positions, compute awards to players based on their playing activity, photograph individual players, transmit player's images to casino security/surveillance departments and or other authorized casino personnel and perform other functions as described herein.

In further embodiments, the system may activate table displays that indicate each player's win/loss/draw of their bets, and/or dealer's card count, indicate in the game of blackjack when a dealer has blackjack, or any other significant event that occurs such as indicating when a player has a winning/loss/draw on specific card combinations. According to further specific embodiments, the invention involves a fully automated monitoring and accounting system for casino table games.

In further embodiments, a card holder of the invention can also: (1) communicate with any suitable component when that component relates to a specific table activity; (2) scan and change the data base contained in devices that utilize components that interface with the electronic components contained and or attached to the holder: (3) photograph players; (4) scan and monitor game operator (dealer) activity; (5) allow players to request extra bet positions to be displayed on a game table; (6) calculate and totalize players win and loss of their game activity (7) calculate player awards (comps), players win loss, and odds on players.

2. Example Smart Hand Held Card Holder

In order to more easily illustrate the general concepts and components of the invention, reference is made to FIG. 1. FIG. 1 illustrate an example embodiment of a hand-held smart card holder according to specific embodiments of the invention including a number of optional components. While FIG. 1 illustrates a particular mechanical configuration with particular electronic components, it will be apparent to those of skill in the art that the invention may be embodied in a wide variety of different configurations of a card holder. According to specific embodiments of the invention and as discussed herein, a HHCH is a primary component for tracking one or more of (1) movement, deal, and/or totals of table game playing cards; (2) movement, bets, validity, or totals of table game radio frequency gaming chips; (3) movement, identify, requests and/or activity of table game participants such as players or game operators (dealers); (4) win/loss totals of table game players and/or a casino; (5) photographs table game players; (6) history of table game events.

Mechanical Components, Housing, Power, Logic Controller

In specific embodiments, an HHCH 1 of the invention has mechanical components to facilitate holding and dealing playing cards. In one example implementation, a card holder 1, has a housing as shown. A mechanical spring loaded card pusher 40 pushes the cards towards card retainers 41 allowing the positioning of the playing card to be easily dispensed by a card dealer. Card retainer stops 42 are hinged to allow cards to be loaded within the card holder. Card cover 43 includes opening 44 from which a dealer can withdraw a card. In specific embodiments, card gate 45 is a card stop that can be activated by players' card request buttons. With these mechanical components, a single playing card (such as 12*a*) can be dealt from the holder while the remaining cards (such as 12*b*) stay in the holder compartment. Cards can be dealt face up or face down, though face down is the more usual configuration.

According to specific embodiments of the invention, an HHCH includes one or more of several electronic components, as described below. These generally are powered by a power supply, such as 30, which may be rechargeable and/or replaceable as is understood in the art and optionally may be attachable to power cord 31 to receive power and/or for recharging. Logic processing electronics 32 provides the digital data processing ability to facilitate operation of the card holder. In terms of its overall electrical and central logic processing operation, card holder 1 can operate and be constructed in a similar fashion to any familiar portable electronic information processing device. Thus, a card holder of the invention can be constructed using any portable power supply (such as a battery) as used in portable computers or cell phones. Recharging can be by means of switching batteries, connecting to a power cord, placing in a cradle with recharge connections, or wireless induction, as understood for other portably electronic devices. Electronic 32 can include any logic processing devices such as generic microprocessors, customized microprocessors, RAM memory, ROM memory, interface circuits, ASICs, non-volatile memory, hard disk storage, memory card storage and/or interfacing, etc. Such components are well understood as used in portable devices such as computers, cell-phones, cameras, media players, etc. Electronics 32 also generally will contain one or more network interfaces 33, such as secure WiFi, Bluetooth, or Wireless Ethernet, that allow the HHCH to communicate with external data handling systems within the casino, also as will be familiar in the art.

Prior card holding devices, including holders that shuffle playing cards, contain electronic data interface components that utilize data interface cables that connect directly and or indirectly with various table and casino databases. Hard-wired data connections and or cables restrict the portability of the Table Mounted Card holding devices. Thus, in preferred embodiments, the invention interfaces with external data bases and information systems utilizing radio frequency interfaces.

Machines that hold playing cards, including card shuffling machines, are powered by connections to the Casino main power supply; if the main power supply fails, then the card holder can no longer function. Thus, in a preferred embodiment, a self contained power supply to electronic devices within and or attached to a HHCH, increases the capability of further automation of table games.

Output 34 can include a visual display screen or lights or audio speaker as know in the portable device art for presenting information to a user. Input controls 35 can include any type of touch-sensitive buttons or screen for receiving user input.

FIG. 1 illustrates a large number of different electronic components which are described below. Many of these are alternative and/or optional components and not all components illustrated and described will be present in all embodiments. One advantage of the invention is that multiple of these functions are brought together in an HHCH of the invention, allowing for enhanced automation and tracking of game play, as described below.

Optical Interface

As an example, FIG. 1 illustrates a holder having four optical scanners 13*a*, 13*b*, 13*c*, 13*d* placed at various positions of the card holder and a optional camera 13*e*. The optical scanners may be identical to one another or each may be a different configuration optimized for its various functions; for example, some of the optical scanners may be highly directional and others may provide a wider-angle or fish-eye vies. Some optical scanners may be sensitive to different light frequencies, such as ultraviolet light. This may be useful, for example, in detecting various gaming table trigger marks or optical patterns that are printed in UV reflective ink or paints. Not all embodiments will include all optical scanners or in some cases any optical scanners. Optical scanning can include visible light scanning or laser enable scanning, such as bar code reading, or UV scanning.

Playing Card Optical Scanner 13*a* is positioned to be able to easily optically scan a card as it leaves the card shoe. Various patterns on the card may identify one or more of the cards suit, value, or unique identity and these patterns are read by the optical scanner and the data read is stored by electronics 32.

Table Optical Scanner 13*b* is positioned to be able to optically read events on a gaming table. Depending on the particular implementation, these events may include one or more of: trigger marks indicating a position on a table, deal of a card to a particular position on a table, placement of chips at a position on a table. Various optical patterns, as will be understood in the art, can be placed on a gaming table, or playing cards, or chips to facilitate optical recognition.

Dealer Optical Scanner 13*c* is positioned to be able to optically read events on a gaming table generally below and behind the hand-held holder.

ID Card Optical Scanner 13*d* is positioned to be able to easily optically scan an ID card that is placed in slot 17. Such an ID card can include a credit card, player reward card, or player betting credit card. Data read is processed by electronics 32 and communicated with external systems, such as credit card processing systems, as necessary.

Camera 13*e* photographs players who are stationed at the gaming table. The signal to activate the camera may be derived from other scanners in the shoe or at the table. The various departments within the casino may interface with the HHCH to activate camera 13*e* located in and/or adjacent to the HHCH, said camera may take images of players, and send those images to desirable casino locations and computer systems. This can increases security by allowing photographs of players to be transmitted for analysis and also for specific player identification. Facial recognition system may be completely within the structure of the HHCH or conveniently located within desirable location within and or outside the Casino. The HHCH may activate switches to initialize one or more cameras, (not located on or in the HHCH) to photograph game participants. This increases security by facial recognition of unwelcome table game participants and provides an economic plus for the casino. By placing a camera on a card holder of the invention, surveillance and/or facial recognition may be improved because the camera is positioned to get a better view of a players face.

In specific embodiments, an optical scanner scans optical patterns that are inherent and/or printed on playing cards. Data read by the optical scanner may be interfaced with other data handling components as described further herein (e.g., one or more radio frequency (RF) transponders and/or one or more magnetic interfaces) to track game or table activity. In specific embodiments of the present invention, the playing cards used may be of one or more configurations.

In other embodiments, optical scanning alone of standard playing cards may be used to identify individual playing card values at a table. For example, consider the case where a table uses five different decks of cards, each with a different design on the back of the playing card. In such a case, one or two optical scanners that can read the design on the back of the playing card as well as the suit and value on the face of the card, can uniquely identify each card dealt, even though there will be five cards with the same suit/value in use at the table. In further embodiments, optical scanning of playing cards may be used to identify individual playing cards at a table where an optically readable identifier has been printed on each card. Consider, for example, a casino that uses up to a million decks of playing cards in a given period. Each deck may be marked with an ink that is not visible to the human eye (for example an ultra-violet and or infrared ink) that identifies the deck. With a simple numbering scheme of, for example, 000000 to 999999 printed on the face or on the back of each card in a deck, every card in a casino can be uniquely optically identified because each card has optical markings indicating its suit and value and also optical marks indicating its deck, thus providing for unique identification of 52 million cards in a casino when using 52-card decks. Alternatively, each deck may have a visible pattern difference that is not discernable to a human viewer, but is detectable by an optical scanner according to specific embodiments of the invention. Thus, in specific embodiments of the invention, each playing card may have it's own individual finger print that can be read optically.

RF Interface

As a further example, FIG. 1 illustrates four radio frequency (RF) transponders 14*a*, 14*b*, 14*c* and 14*d*. The transponders may be identical or each may be a different configuration optimized for its various functions. Not all embodiments will include all the transponders shown, and due to the wireless nature of the transponders, in some embodiments, the four functions described below will be performed by fewer or more transponders than shown.

Playing Card Transponder 14*a* is positioned to be able to easily read and write data using RF from a playing card as it leaves the card holder. Various technologies for RF transponders in flat objects such as playing cards are known. According to the invention, a playing card with a transponder is able to receive and store data and later transmit that data. Transponder data written to or read from the card can include, in various embodiments, one or more of the card's suit, value, unique identity, identity of player to whom card is dealt, identity of previous card dealt to that player, identity of previous n cards dealt from the deck, when n indicates any desired number of cards, time card was dealt, beginning time of the game, or any other data deemed useful to accomplish the various features and advantageous of various embodiments described herein.

Table Transponder 14*b* is positioned to be able to transmit and/or receive data from antenna or transponder devices on a gaming table. Depending on the particular implementation, these transponder devices may include one or more of: in or under table antenna, playing cards on a table, chips on a table, player identification cards on a table.

Dealer Transponder 14*c* is positioned to be able to communicate with antenna transponder devices below and behind the hand-held holder.

ID Card Transponder 14*d* is positioned to be able to easily communicate with an ID card that is placed in slot 17. Such an ID card can include a credit card, player reward card, or player betting credit card. Data read is processed by electronics 32 and communicated with external systems, such as credit card processing systems, as necessary.

Magnetic Interfaces

As a further example, FIG. 1 illustrates two magnetic read or read/write heads 15*a* and 15*b*. Playing Card Magnetic Head 15*a* is positioned to be able to easily read and or write data to magnetic particles on a playing card. These particles can be arranged in a strip on the surface or just underneath the face of a playing card or in the ink placed on the front or back of a playing card optically scan a card as it leaves the card shoe. Various patterns on the card may identify one or more of the cards suit, value, or unique identity and these patterns are read by the optical scanner and the data read is stored by electronics 32.

ID Card Magnetic Head 15*b* is positioned to be able to easily read and/or write to a magnetic strip on an ID card that is placed in slot 17. Such an ID card can include a credit card, player reward card, or player betting credit card. Data read is processed by electronics 32 and communicated with external systems, such as credit card processing systems, as necessary.

The magnetic components reads and/or writes data to magnetic particles (such as ferrite oxide particles) that are inherent and/or placed on playing cards. In this embodiment, playing cards can have data magnetically written to them according to what may be deemed as useful to the card game, e.g., name of player and or dealer receiving card, time card was dealt to game participant, etc. In specific embodiments, magnetic reading alone may be used to identify individual playing cards at a table. In such a case, each card may either be provided with unique identifying magnetic data prior to being placed in the shoe. Alternatively, a magnetic particle area on the card may be blank (as in a blank video or audio cassette tape) when first placed in a shoe, and identifying data may be written by the shoe onto the card during the deal from the shoe. In this embodiment, playing cards may be supplied to the casino in multiple identical decks, with each card in each deck having a blank magnetic particle portion (or blank RFID memory portion) that can be used for recording identifying data by a card shoe of the invention.

The magnetic components reads and/or writes data to magnetic particles (such as ferrite oxide particles) that are inherent and/or placed on playing cards. Data read by the magnetic components may be interfaced with other data handling components as described further herein (e.g., one or more radio frequency (RF) transponders and/or one or more optical scanners) to track game or table activity.

In further embodiments, optical playing card suit and value markings contain magnetic reading and/or recording particles allowing the cards suit and value to be read by the magnetic components of the holder. The magnetic components can record a variety of information related to the table card game onto the playing card, e.g., identity of player receiving the card; time when player received the card, identifying the bet position where card will be placed, such as split cards, extra bets areas, the value of bet and the values of the cards dealt to specific game participants placed relating to cards being dealt to player or dealer, etc. Magnetic particles on playing cards may be placed in any convenient area on the playing cards.

In further embodiments, optical scanning is used in conjunction with magnetic writing to playing cards so that a card's suit, value and/or other pertinent information is determined by the optical scanner, and that data is written to the playing card along with other identifying data. Such a system allows the playing card to be identified by a read/write magnetic head and/or an optical scanner. In such a system, a shoe according to the invention can exchange data between two different interface methods, such as reading a card identity optically and then writing that data electronically.

In further embodiments, a shoe is associated with a magnetic read/write head or a transponder that can interface to players' credit cards, identity cards, award cards, etc., such as 15*b*. This read/write head can allow game data to be written to or read from these cards. In specific embodiments, the read/write head may be the same head used for reading and writing playing cards. In other embodiments, a separate head either included on the shoe or mounted elsewhere on the table is used. In some preferred embodiments, a reader is incorporated with a portable HHCH to reduce costs and complexity of the system.

A number of methods are known for incorporating magnetic particles that can be read and written into flat card-type objects, such as plastic credit cards, paper or cardboard mass transportation fare cards, etc. Various methods for adapting any of this preexisting technology to playing cards will be understood to those of skill in the art having benefit of the teachings provided herein. Magnetic particles in playing cards have been used in the past, they have not been interfaced as in the invention.

In some applications, a card holder of the invention can contain an direct electronic interface rather than magnetic heads or in combination with. This interface most commonly could be used with a ID card or ID dongle. In this use, a dongle is any hardware device used for identity authentication or credit. Dongles may be incorporated in "USB-key" type device, in which case the present invention may include a USB interface in addition to or instead of magnetic head 15*b*. A memory interface may also be used for playing cards with incorporated non-wireless memory.

Interfaces in Combination

An important aspect of a HHCH according to specific embodiments of the invention is that data from any of the interfaces shown in FIG. 1 can be freely exchanged between the interfaces and can be stored, operated upon, or transmitted outside of the HHCH by electronics 32. For example, data read by the magnetic components may be interfaced with other data handling components as described further herein (e.g., one or more radio frequency (RF) transponders and/or one or more optical scanners) to track game or table activity.

3. Playing Cards

Figure 2:
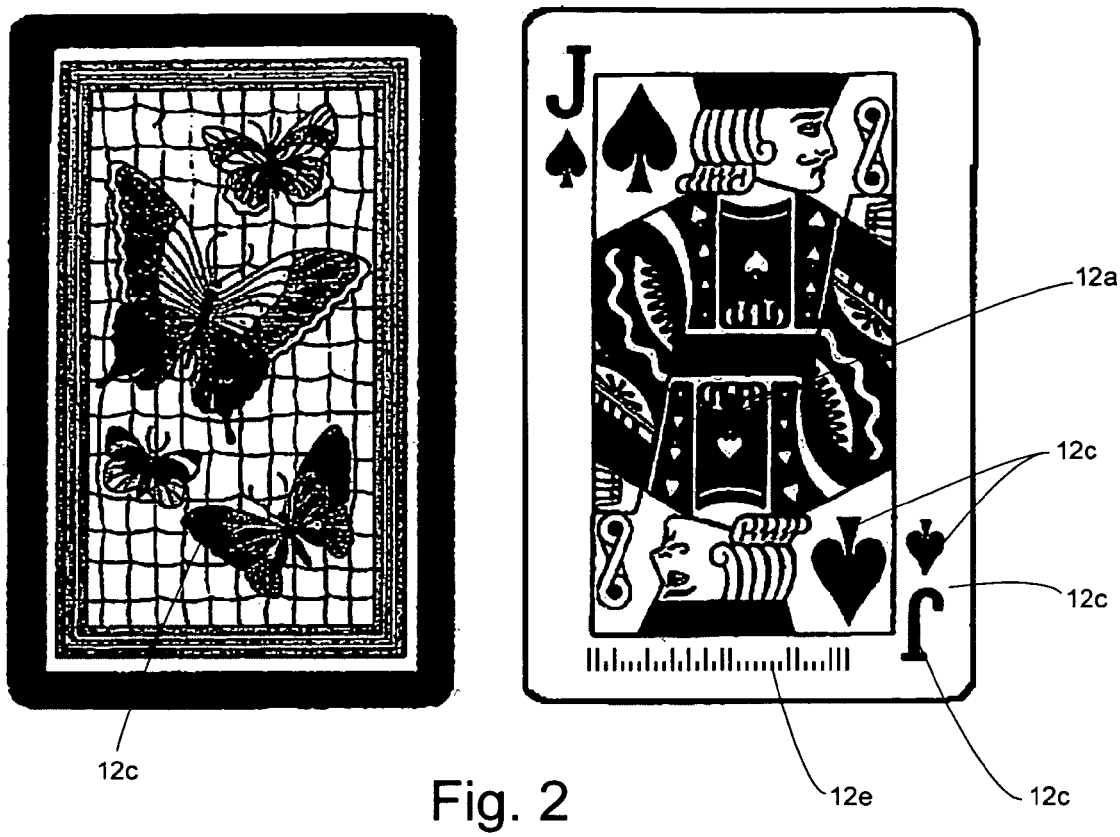
FIG. 2 illustrates one example of a playing card with components according to specific embodiments of the invention.

According to specific embodiments, an important feature of playing cards of the invention is that they provide a means to be uniquely identified by one or more automatic scanning devices at a gaming table. This means may be permanently incorporated into a playing card, such as using bar codes, visual pattern, or read-only electronic data. In such a case, a playing card may not include a feature of being written to during game play. In a preferred embodiment, playing cards of the invention include a writable memory, such as a magnetic particle area or a transponder with a memory storage. In such a case, a unique identity may be written to playing cards as they are handled or dealt at a table and further data regarding tracking card play can also be written to the playing cards. FIG. 2 illustrates one example of a playing card with components according to specific embodiments of the invention. In specific embodiments, cards 12 include visually perceptible patterns such as 12*c* that are historical elements of playing cards (e.g., suit and value on the face of the card and deck pattern on the back of the card). In specific embodiments of the present invention, these patterns are printing with a color and/or contrast and/or shape that makes them easily read by an optical reader incorporated into a shoe of the invention. In further embodiments, cards may have printed on their face an optical pattern such as a bar code 12*e*, which uniquely identifies that card from any other card of the same suit or value that may exist in the casino. In some embodiments, this identifier may be embedded into a pattern that is not easily perceived or easily read by a human viewer. In other embodiments, this pattern may be easily recognized by a human viewer, but because the pattern only appears on the face side of the card, it is not critical that the human viewer can detect or recognize the pattern.

In other embodiments, a unique pattern may be placed on the backside of a playing card. In this case, in particular embodiments, it is important that the pattern not be "readable" by a player. This can be accomplished by including the pattern in a set of dots or rows that may appear not to contain identifying information to a human viewer, but that can be optically read by a card holder. In further embodiments, optical patterns 12*c* can further include magnetic particles to make the patterns electronically readable to card shoe, but generally not to a human viewer, and also in further embodiments, to make the cards writable by the card shoe. These magnetic particles can be printed or embedded into various areas of the card so as to make them visually indistinguishable from other card patterns. As discussed above, these patterns can permanently convey one or more of at least three items of information: (1) the card suit; (2) the card value (3) a unique identification of the card to distinguish it from all other cards that might be present in the casino, which in some situations can be upwards of many millions of different is cards. In further embodiments, the magnetic particles can be configured to store data placed on them by electronic writers in the card shoe or elsewhere in the system. This data can include such information as when the card was played from the shoe, the identity of the player to whom the card was dealt or played, the card related bet position and identifying information regarding the card, such as the table at which the card was played or a unique identification for the playing card. Magnetic particles can also be embedded into a magnetic strip such as shown in 12*f*.

In further embodiments, playing cards 12 can also include radio frequency transponder 12*d* embedded within the card. These transponders can either substitute for magnetic particles or work in addition to them. Where present, transponders 12*d* allow a card to send and/or receive data from the card shoe and also from other positions on the table. Transponders 12*d* can be implemented by various flat transponder technologies that are know in the art or by other transmit/receive technologies, such as smart dust. RF transponders can also include RF microchips, and/or printed RF transponders and alternate methods of providing suitable RF transponders.

A read/write playing card according to specific embodiments of the invention with a two way interface to a smart holder of the invention allows for more complete tracks of playing cards for greater security and game automation. This allows more card games to be played within a specific time period, which is an economic plus for the Casino. The system also allows sequence scanning of cards (e.g., the first card dealt to a player may be a 3 of diamonds, the second card to the same player may be a 5 of hearts, the second card would contain the data received from the first card, plus the second card reading and also contain the total value (history of cards dealt) to a specific game participant) and in further embodiments allows correlation of bets with playing cards.

4. Other Devices

In further embodiments, the invention may be employed as part of a system that includes other gaming devices that interact with a card holder and/or playing cards of the invention. A description of example devices is provided below, though other devices may be used in various implementations.

Chips

As described above, technologies for incorporating R/W RFID transponders into gaming chips are known. An example of such a chip 16 with transponder 16*a* and/or electronic dust 16*b* is shown in FIG. 1. In particular embodiments, such chips may be read and/or written to by a holder of the invention and may interface with other devices as described herein.

There are table game monitoring systems that utilize gaming chips that have embedded radio frequency transponders, said gaming chips are scanned by stationary antennas placed underneath the gaming table, each participant in the table game have their own dedicated antennas which monitors their gaming chip activity. While this system worked for scanning gaming chips when they are placed above each participants area of chip placement, it does not lend itself to scanning radio frequency gaming chips in areas where there are no antennas placed underneath the gaming table.

According to specific embodiments of the invention, the radio frequency transponders within or attached to the HHCH may scan gaming chips that contain radio frequency transponders and determine values for each gaming chip, and create a total value of all gaming chips scanned within specific areas, such areas may be where players place their bets and also where dealers place their bankroll of gaming chips. In a specific embodiment, a read/write transponder within or attached to the HHCH may interface with transponders, such as in-table or chip-tray transponders, that are located near gaming chips. Alternatively, an HHCH transponder can alone scan all gaming chips.

Game Table

In specific embodiments, a gaming table 20 can have one or more components that interact with other devices in a system of the invention. Table optical markings can be used that allow the HHCH to determine by optical scanning various table events and activities such as to which player a card is being dealt and to perform other functions related to the table game. In further implementations, optical patterns are placed at strategic positions on a gaming table to allow an optical scanner to track when bets are placed, when a dealer chip tray is in place, etc.

In further embodiments, a table contains one or more transponders that can communicate with the shoe and/or playing cards and/or player identification cards and/or chips. Table transponders are placed on or in or under the table game surface, such interfacing allows the table game transponders to communicate data such as one or more of: player identification, player bet positions, player cards received, player requests for playing cards, player bet information, player requests for extra bet areas, players side bet information, player bet counts, dealers (game operator) bet count, plus dealers announcement of significant events such as dealer having blackjack, etc.

Techniques for incorporating transponders into gaming tables and/or for providing optical markings or triggers are known in the art.

Electronic devices within and or attached to the HHCH, may be optically triggered by table marks placed in and/or attached to the gaming table. These marks trigger optical sensors within and or attached to the HHCH, which in turn activate Radio Frequency antenna and or antennas within the HHCH, thereby allowing those devices to scan gaming chips that contain radio frequency transponders, which are placed within the boundaries referenced by said table optical marks. Table trigger marks may also identify specific game participants where each game participant position has dedicated optical marks and or markings.

5. Game Play Operation

Figure 3:
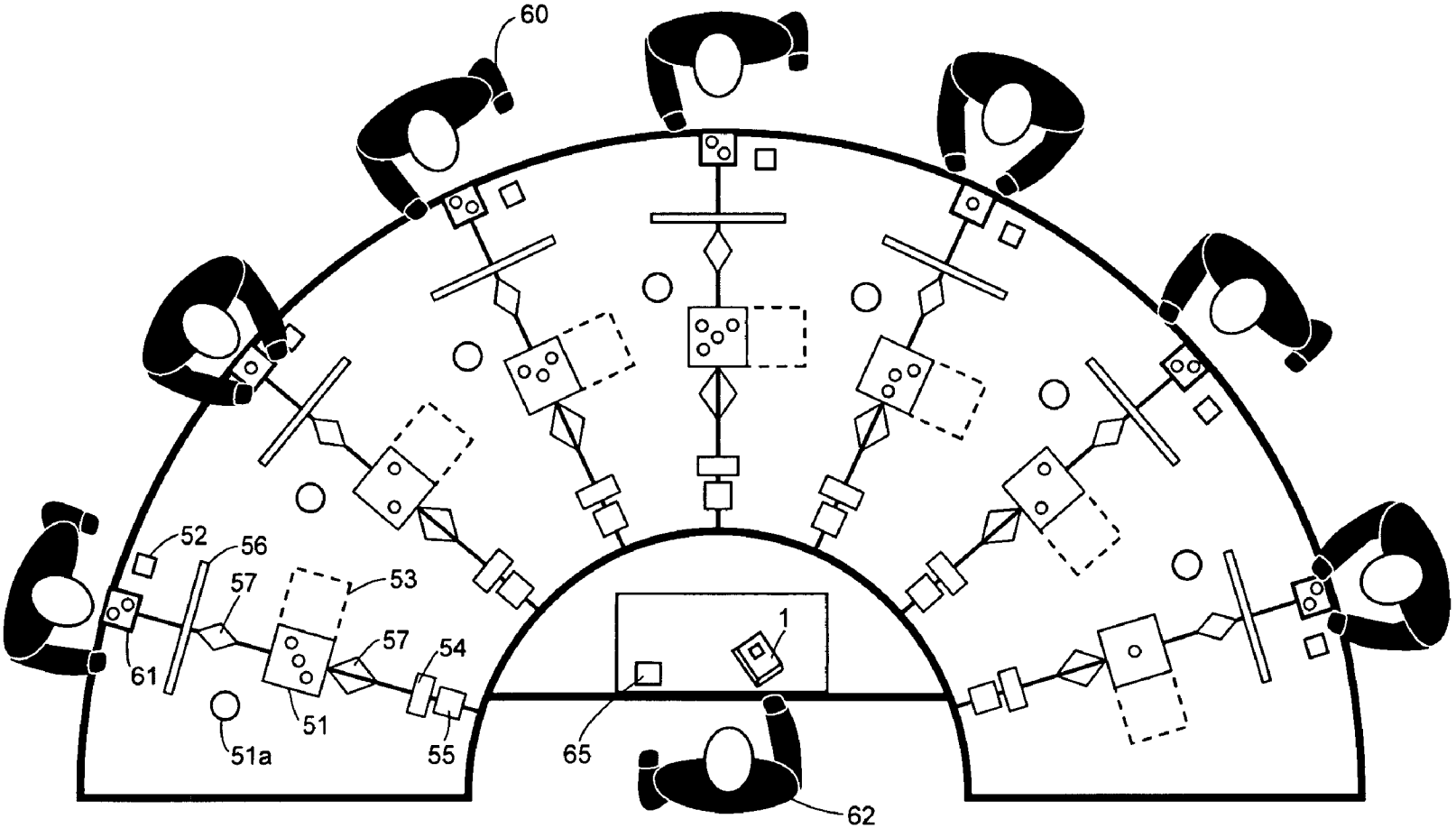
FIG. 3 is a top view illustrating one example of a game table showing a card holder according to specific embodiments of the invention and other table elements, with a detailed description of the elements present at one player position.

FIG. 3 is a top view illustrating one example of a game table showing a card holder according to specific embodiments of the invention and other table elements, with a detailed description of the elements present at one player position.

Figure 4:
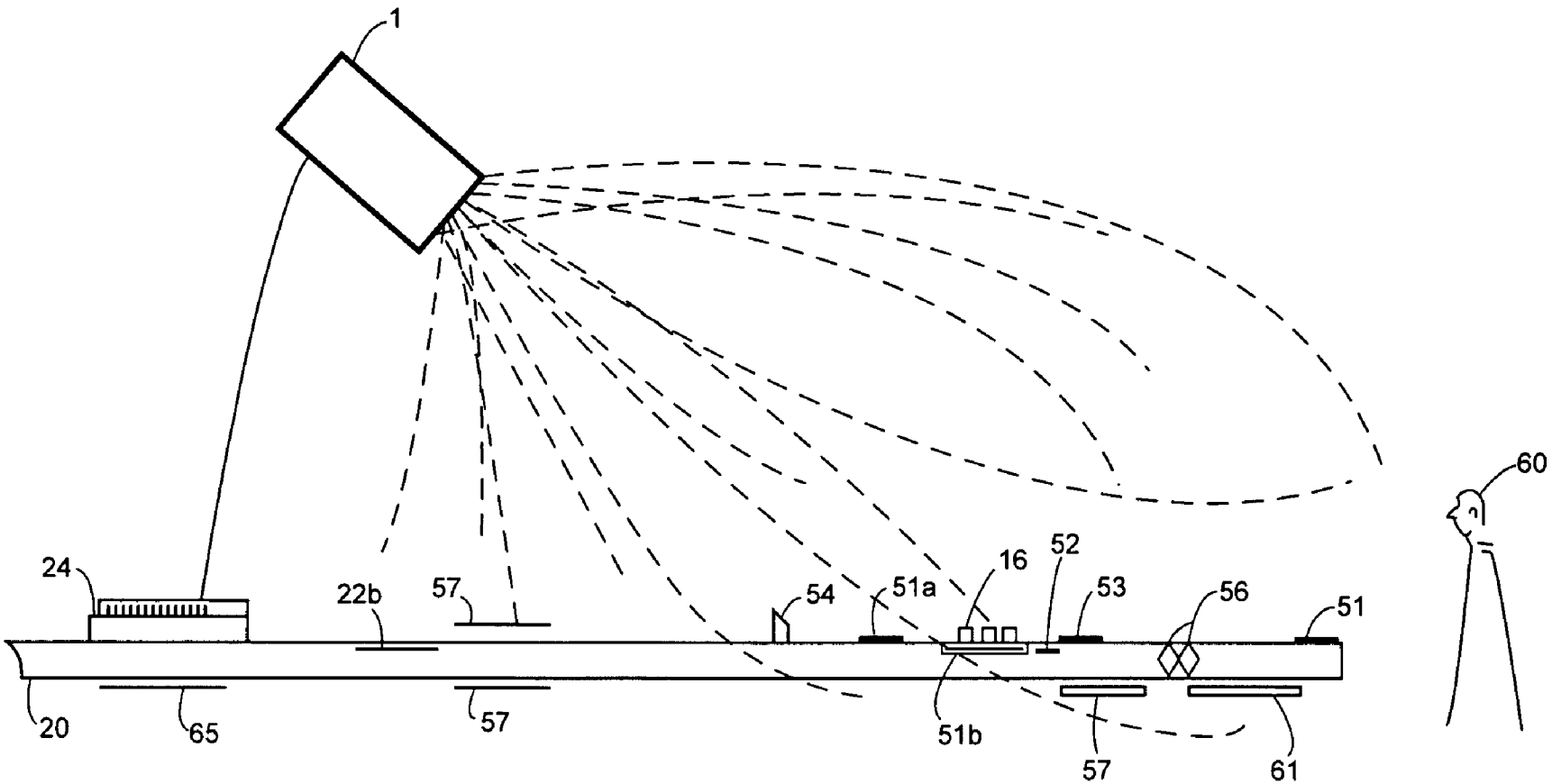
FIG. 4 is a side view illustrating one example of a game table showing a card holder according to specific embodiments of the invention and other table elements, with a detailed description of the elements present at one player position and showing examples of wireless data communication between elements.

This figure illustrates the multiple channels of communication that can take place between a hand held card holder and various table components. The figure also illustrate that the position of the HHCH above the able allows the holder to more easily gather information from cards and/or chips and/or other components. FIG. 4 is a side view illustrating one example of a game table showing a card holder according to specific embodiments of the invention and other table elements, with a detailed description of the elements present at one player position and showing examples of wireless data communication between elements. For illustrative purposes, FIG. 4 shows seven players 50B and a dealer 56. As described above, a card holder in such a table game includes intelligence and components that allow reading, writing, and tracking of cards at a gaming table either alone or with other table electronics as shown.

Various example components are shown in FIG. 3 and FIG. 4 to facilitate operation according to specific embodiments of the invention. It will be understood that not all components shown will be present in all embodiments.

Card Tracking

In specific embodiments, an important component of game automation according to the invention is tracking and storing a history of play of gaming cards. Using FIG. 1 as an example, game playing cards 12 are scanned or read by at least one of the interfaces described above as they are dealt to a player. In preferred embodiments, at a minimum, a card holder of the invention stores the unique identity of each playing card, the player to whom the card is dealt. In further embodiments, a card holder of the invention stores the time that each card is dealt. In some embodiments, this data is stored on a storage media by electronics 32. In other embodiments, this data is stored on magnetic particles or a transponder memory of each playing card as it is dealt.

Thus, according to specific embodiment, the present invention is able to track an individual playing card so that an unscrupulous player can not hold it for next game or keep it. In specific embodiments, the holder itself can determine and record on a playing card identifying information such as when it was dealt, the player it was dealt to, etc. Thus, even with a holder only implementation, the invention can track a playing card to determine if a player retained that card fraudulently or passed it to a friend or accomplice at a table. The invention also checks for counterfeit cards or from cards that have been introduced from another table or held from a previous game.

Thus, while in some earlier stationary card shoes, card readers are placed in stationary card shoes with a playing card with a transponders in them and optionally with an antenna under the table, in these systems cards are only read by components of the table. In the present invention, components in the table can write to the playing cards, which can be tracked, modified, and/or encoded by the shoe or table.

Returning to FIG. 3 and FIG. 4, card tracking can also be accomplished using other components, such as table player identification area 61, where a player can place an identity card or other identity device. These are interfaced to card motion sensors 56, which in specific embodiments assists the playing card holder to receive signals to recognize a specific card. In further embodiments, one or more table transponders 57 interface with player main bet area 51 and player's optional second main bet area 53, and side bet area 51*a*. Each of these areas also may have their own transponders. In a table system, each of the components shown can be in communication with other table components and a card holder of the invention.

In further embodiments, a holder of the invention interfaces with a player input 52, which is a mechanical and/or electronic means for a player to indicate a card request and optionally for that request to be transmitted and/or recorded e.g., via a transponder or via a conducting electrical connection. Area 61 illustrates an optical and/or electronic means for player identification and optionally for that identification to be transmitted and/or recorded e.g., via a transponder or via a conducting electrical connection. This area can also serve as an area for player chips to be held. 51 illustrates a main bet area; 51*a* illustrates a side bet area; 52 indicates optical triggers on a table that allow a hand held holder to detect table activity; 53 illustrates an optional second main bets area; 54 illustrates optional player displays; 56 illustrates card motion sensor and card interfacing sensing, which, according to specific embodiments of the invention, can reads RF transponders in playing cards and/or credit cards or player identification cards; 57 illustrates two further player transponders; 65 illustrates a dealer transponder.

FIG. 4 is a side view illustrating one example of a game table showing a card holder according to specific embodiments of the invention and other table elements, with a detailed description of the elements present at one player position and showing examples of wireless data communication between elements. In addition to elements described above, FIG. 4 also shows an additional in-table antenna 22*b* and a dealer chip tray 24.

Card Requests

It is not uncommon for a player to request another playing card by a hand signal, upon receiving another Playing Card, they then deny they requested another Card, and or the Dealer misinterpreted their Hand Signal. Table game players utilize various hands signals that are interpreted by the Dealer as indicating the player wishes to receive or decline to receive another playing Card to their existing hand of cards. Players often give confusing Hand Signals, and the dealer is often accused by the player that the dealer misinterpreted the player's hand signal. In further embodiments, the invention interfaces with a button or motion sensor, such as 52, at each player's card receiving area. If player wants a card, a card request button or motion sensor interfaces with a handheld or table mounted card holder to indicate that the player has requested a playing card and can record on the card that the player actually received it. This can help prevent or resolve disputes such as when a player asserts that they requested or did not a request a particular card after the card is dealt. In such disputes, time is wasted and enjoyment of play can be diminished for other players and stress can be increased on the dealer. According to specific embodiments of the present invention, the system records that a player for example pressed a request card button and received that card and what card it was. Thus use of a positive indicator such as a button at a gaming table along with a shoe that can record card play in another novel aspect according to specific embodiments of the invention. Requiring the player to activate a switch when they wish to receive a playing card eliminates the confusion created by disagreements between the player and the card dealer, as the players switch activation is recorded for future reference, and no hand signal interpretation is required by the card dealer. This feature allows more games to be played within a specific time period, creating an economic plus for the Casino, and reduces disputes and opportunities for participants to cheat.

In further embodiments, the playing card holder radio transponder may interface either electronically or via RF communication with various players requests related to a game, e.g., a player requesting another card, requesting more bet areas, (such as having another main bet area, similar to playing more than one hand of cards), and/or placing side bets etc.

In further embodiments, an HHCH contains a method to dispense and or not dispense playing cards to players, by receiving a player's request signal and thereby appropriately activating a hinge or card stop or card gate to allow a card to be dealt. For example, a player activated switch may send a radio frequency signal or other signal to the HHCH and this signal activates directly and/or indirectly a playing card feed mechanism, which allows the dispensing and or partial dispensing of the playing card.

Holder electronics can further activate a visual signal (using a display or light element) or an audio signal to the card dealer that the player wishes to receive a playing card, the signal received by the electronics within the HHCH, may also activate a mechanism that will allow the Dealer to manually dispense a Playing Card to the Player.

In specific embodiments, a player switch may activate a drive roller within a hand held card holder to deliver a card to the specific player. A HHCH can include motorized ejection of the playing card, partial motorized dispensing of the playing card with final removal by manual action, removal by manual action with a block that is lowered only when a card has been requested, or total manual removal of the playing card from the HHCH. Some embodiments that are intended for manual removal of the playing cards will not include a motorized feed system.

Table Displays

In specific embodiments, a card holder interfaces with various table displays to display data relating to players running card count, player win/loss/draw outcome, side bet win/loss/draw outcome, game operators significant card count display etc. Displays inform players about their running card counts, and also in the case of blackjack, if the dealer has a blackjack hand of cards, by automatically counting the cards a dealer receives, it is no longer necessary for the dealer to manually place their cards in a table mounted card reader, which is dedicated to said dealer. By players having their displayed card counts, and game operator displaying if they have a blackjack the table game is speeded up allowing more games to be played within a specific time period.

Certain game events may be displayed that are related to game participants and activated by the HHCH to each and or all the game participants during a game. These events may include be displayed on a small display in front of a player that shows a total card count of the player's hand, and also the total count of the dealer's hand. Any event that is recorded by the HHCH and or its interfaced devices, if chosen may be displayed to those dealers, players, and casino operators.

In further embodiments, the invention may change table displays in cases where a table bet areas may be electronically indicate according to requirements of the table game, for example a player may wish to have more than one bet position, and the HHCH can interface with displays to increase and or decrease player bet positions.

Automatic Card Count

In most casino games, players and card dealers have the responsibility to count the playing cards they have received. It is not unusual for players or dealers to miscount their cards, which miscounting may cause interruptions of the card game. In general, existing table electronic systems do not display a player and or dealers card counts. In specific embodiments, the present invention addresses this by providing card counts to each player at their table display. In games such as Blackjack the Ace card may be counted as a one or eleven. Very often players find it difficult to determine the playing hand total when they have the choice to count the ace as a one or eleven. Thus, in specific embodiments, a player card count display showing both totals, using the ace as an eleven, and another showing the ace as a one, provides players with an easy reference regarding their card count. Furthermore, in Blackjack, when one of the dealer's first two cards shows a ten, Jack, Queen, King, Ace, the dealer is required to place their non-exposed card under a device that allows the dealer to determine if he has 21 or Blackjack, which is then announced to all the players at the table. With this determination made automatically by the invention, manual labor and dealer error are reduced, increasing the amount of Card Games that can be played within a specific time period.

Thus, in further embodiments, the invention facilitates speed of game play by providing a digital and/or audio count for a player as or after a card is dealt. In this situation, play can be facilitated because players sometimes have trouble or are delayed in counting their cards. Dealer announced card counts increase fatigue on the dealer and introduce the possibility of human error by the dealer. Thus, in specific embodiments, the invention reduces or eliminates mistakes or delays caused by the dealer miscounting the cards or players miscounting the cards or being very slow in counting cards.

Data Transmitted to Other Casino Systems

The HHCH may transmit data regarding the win/loss/draw of players and the history of their betting activity including a facial image, provides the casino with a table game history and a photograph of each table game participant. The knowledge of player's activities at the Gaming Table allows the casino to calculate what rewards (comps) a player is awarded. This is an economic plus for a casino, as it avoids a great deal of manual labor by the casino. In specific embodiments, an HHCH of the invention can include antennas and/or transponders and/or detectors that allow the HHCH to interface with any desired object that has specific wave lengths suitable for interfacing to the HHCH.

Chip Tracking

HHCH may include a transponder that can read chips and/or identification cards directly without table antennas or can read chips in combination with one or more table antennas/transponders. In specific embodiments, the HHCH can totalize the value and identification of each gaming chip and relate determine the specific areas where detected gaming chips are placed. In various embodiments, gaming chips 16 may be scanned by chip holder transponders, and or table transponders, and/or HHCH transponders. Transponders generally can read/write/erase data to gaming chips 16 as directed by HHCH electronics. Card holder transponders may interface with each other and also playing card transponders and chip transponders. One or more table transponders can be positioned on the table to interact with gaming chips or player credit or identification cards. Data detected by these transponders is exchanged with the HHCH, for example via transponder 14*b*.

While cameras and/or other optical sensors can also be used to scan gaming chips by identifying markings on individual gaming chips. However, they generally require a line of sight to the gaming chips, and they are not suitable to scan gaming chips for authenticity, as all individual markings only indicate the value of a gaming chip and are not suitable to identify individual gaming chips for individual fingerprints. The invention can recognize each Gaming Chips unique finger print; therefore can check that each Gaming Chip is authentic.

Bet Tracking

Thus, with the ability to track chip placement and table game activity, in further embodiments, an HHCH scans and monitors the amount bet by each player, scans playing cards dealt to specific players and correlates bets with playing cards, thereby determining whether an individual player had a win/lost/draw outcome of their play. By receiving and storing what player receives specific playing cards, how much each player bet, a history of game participants' significant events, and a time record of significant game activity relating to all game participants, and other data as discussed herein, casino manual labor is reduced, which is an economic plus for the casino. In various embodiments, the invention allows real time accounting of a casino's win/loss position at one game or at many games and of an individual player's win/loss position, which may be provided or displayed to a player or used by the casino. An HHCH also facilitates the tracking of side bets. Table game automation can be programmed for specific table games and variations thereof.

In embodiments where card activity information is correlated with the amount of gaming chips placed by the player in their bet placement areas, a holder of the invention may collect data from multiple gaming table antennas and/or transponders that are placed in relevant areas to interface with chips. In various implementations, table activity may be detected and/or recorded in both the table transponders and the HHCH Transponders. Each game participant and their position at the gaming table may be identified. Table Game Chip storage areas are identified.

Bet tracking according to specific embodiments of the invention is important because players have been known to fraudulently reduce or increase their bet amounts during a time period when no more betting activity is allowed. Generally, detecting this Player cheating requires costly casino manual labor, as present card holder systems generally do not automatically recognize out of time player activity.

In some embodiments, areas wherein players place their gaming chip bets may be identified by optical markers that are scanned by the optical sensor contained within and or attached to the HHCH.

As discussed herein, an HHCH of the invention can scan and/or have a two way data interface with players identification cards, credit cards, credit tickets, dongles, promotional documents, etc. An HHCH can hold one or more decks of playing cards, and can scan and also has the option to transfer data to playing cards. An HHCH according to specific embodiments has read and write functions, allowing said card holder to scan/read and record and or erase data to playing cards thereby giving each playing card it own unique finger print. The system records that a specific player receives a specific playing card.

Side Bets and Split Bets

In some card games, players at times have the option to place a side bet, which is a separate bet from the main game. Side bets often have different rules than the main game and are bets that an event will occur related to cards dealt to the main card hand. If a winning event occurs related to the side bet, then the dealer pays the winning side bet. These side bet winnings may have various odds related to specific cards dealt to the player's main card hand. Generally, not only does the dealer have to be aware of the player's main card hand, but also the dealer has to determine the odds paid to the various combinations of winning events on the side bet. While side bets can be lucrative to a casino, they also take time from the playing of the main card game.

In further embodiments, the invention facilitates side bets, such as are sometimes allowed in blackjack. In blackjack, for example, these side bets are separate from but connected to the main bet. In a side bet, the main bet can go bust, but the side bet remains active. The present invention eases tracking and accounting for side bets for dealers and players alike. Having an automated side bet accounting system saves on manual labor cost and speeds up overall game play.

In a similar fashion, the invention facilitates split betting for blackjack. When a bet is split, that information is communicated immediately to the shoe, and the shoe tracks each card dealt to each position of the split. A split bet may be detected by detecting the game activity, e.g., a player or dealer actually separating an identical pair of cards into two positions or it may be input by a player or a dealer through one of the input devices associated with the system. An HHCH will always be aware of the possibility of a split bet, as it is tracking each card dealt and is programmed to recognize situations in which bets are allowed to be split. An HHCH may provide an indication to a player that a spilt is possible, either audibly or with a visual display.

Strategy Detect

In some instances, a player at a gaming table may have a specific playing strategy that, while not fraudulent or cheating, is not allowed by the Casino. For the Casino to monitor a player's unwelcome strategy, various devices are used to scan dealers and or players cards. In most situations it requires Casino employees to monitor the activity of the player to detect any unwelcome card strategy that player may be using. Late observance and or detection of unwelcome card strategies are a concern to casinos. According to specific embodiments of the invention, the present invention as described above can be programmed with logic that uses one or more of: player identification, identifying players cards, identifying players bets, recording time played, and other player and dealer significant events to detect disallowed strategies. This increases security and allows less manpower necessary to monitor player and dealer activities.

On-Table Holder

Figure 5:
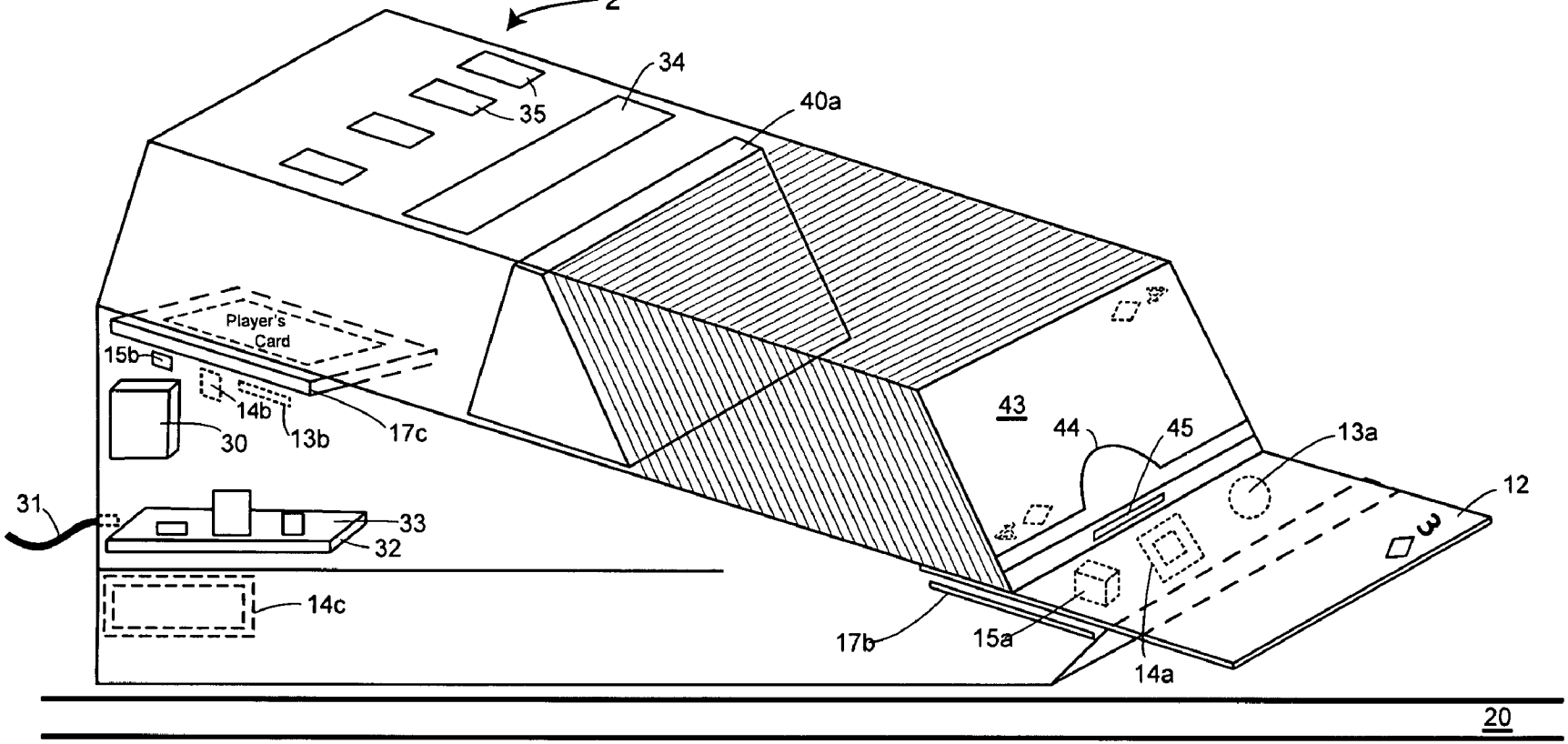
FIG. 5 illustrates an alternative example smart card holder intended to be positioned on a table during game play according to specific embodiments of the invention.

FIG. 5 illustrates an alternative example smart card holder intended to be positioned on a table during game play according to specific embodiments of the invention. This illustrative embodiment is shown as an alternative to FIG. 1 and a number of components as shown in FIG. 5 can be understood with reference to the discussion for FIG. 1. It will be understood that not all components shown will be present in all embodiments. In this example illustration, table card holder 2 is a physical holder for playing cards. with mechanical components to facilitate holding and dealing playing cards. In one example implementation, a card holder 2, has a housing as shown. A weighted card pusher 40*a* pushes the cards towards card retainer/cover 43 allowing the positioning of the playing card to be easily dispensed by a card dealer. Card cover 43 includes opening 44 from which a dealer can withdraw a card. In specific embodiments, card gate 45 is a card stop that can be activated by players' card request buttons. With these mechanical components, a single playing card can be dealt from the holder while the remaining cards stay in the holder compartment. Cards can be dealt face up or face down, though face down is the more usual configuration.

According to specific embodiments of the invention, a table holder, like an HHCH, includes one or more of several electronic components, as described below. These generally are powered by a power supply, such as 30, which may be rechargeable and/or replaceable as is understood in the art and optionally may be attachable to power cord 31 to receive power and/or for recharging. Logic processing electronics 32 provides the digital data processing ability to facilitate operation of the card holder. In terms of its overall electrical and central logic processing operation, card holder 2 can operate and be constructed in a similar fashion to any familiar portable or desktop electronic information processing device. Thus, a card holder of the invention can be constructed using any portable power supply (such as a battery) as used in portable computers. Recharging can be by means of switching batteries, connecting to a power cord or other connecting means as understood for other information devices. Electronic 32 can include any logic processing devices such as generic microprocessors, customized microprocessors, RAM memory, ROM memory, interface circuits, ASICs, non-volatile memory, hard disk storage, memory card storage and/or interfacing, etc. Such components are well understood as used in portable devices such as computers, cell-phones, cameras, media players, etc. Electronics 32 also generally will contain one or more network interfaces 33, such as secure WiFi, Bluetooth, or Wireless Ethernet, or a wired network connection that allow the holder to communicate with external data handling systems within the casino, also as will be familiar in the art.

Output 34 can include a visual display screen or lights or audio speaker as know in the portable device art for presenting information to a user. Input controls 35 can include any type of touch-sensitive buttons or screen for receiving user input.

One variation from the holder shown in FIG. 1 is the number and arrangement of some of the optical, RF, or magnetic interfaces. FIG. 5 shows optical scanner 13*a*, transponder 14*a*, and magnetic interface 15*a*. In general terms, these are designed to work in relation to a card leaving a shoe just as described above. Furthermore, this examples shows two slots for player identify cards, 17*a* and 17*b*. In the option of 17*a*, one or more interfaces 13*a*, 14*a*, and/or 15*a* are used to interface with player identification cards as well as playing cards. Note that this dual use would also be possible in some embodiments of an HHCH. An alternative slot for player identification cards 17*b* is shown, with its own set of possible interfaces 13*b*, 14*b*, and/or 15*b*.

Another variation from the holder shown in FIG. 1 is that in some embodiments, there will be one additional interface, such as 14*c* to connect the antenna and transponders in table 20. In general, though the table positioned shoe can operate in a system that performs all of the features described above, the table positioned shoe must use external devices to scan cards once they leave the shoe or to track chips or other table activity.

Embodiment in a Programmed Information Appliance

Figure 6:
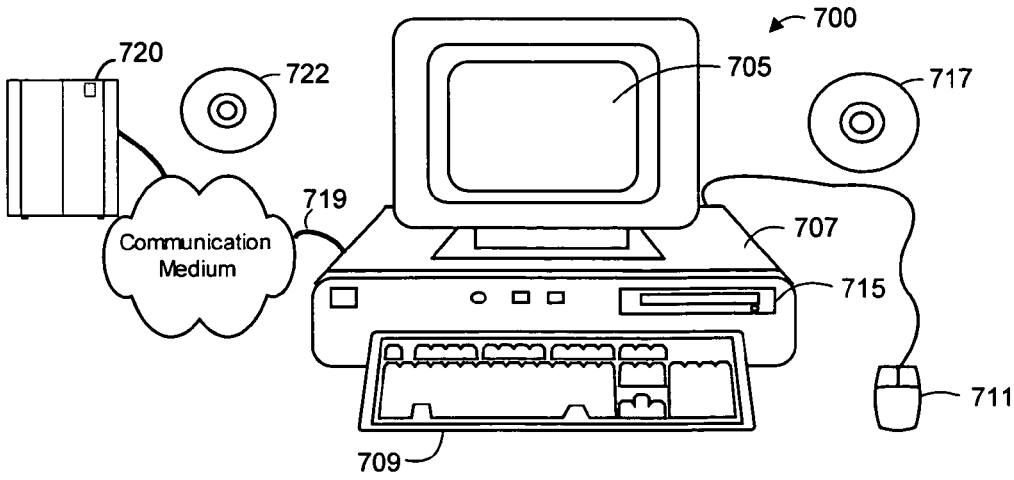
FIG. 6 is a block diagram showing a representative example logic device in which various aspects of the present invention may be embodied.

FIG. 6 is a block diagram showing a representative example logic device in which various aspects of the present invention may be embodied. As will be understood to practitioners in the art from the teachings provided herein, the invention can be implemented in hardware and/or software. In some embodiments of the invention, different aspects of the invention can be implemented in either client-side logic or server-side logic. As will be understood in the art, the invention or components thereof may be embodied in a fixed media program component containing logic instructions and/or data that when loaded into an appropriately configured computing device cause that device to perform according to the invention. As will be understood in the art, a fixed media containing logic instructions may be delivered to a user on a fixed media for physically loading into a user's computer or a fixed media containing logic instructions may reside on a remote server that a user accesses through a communication medium in order to download a program component.

FIG. 6 shows an information appliance (or digital device) 700 that may be understood as a logical apparatus that can read instructions from media 717 and/or network port 719, which can optionally be connected to server 720 having fixed media 722. Apparatus 700 can thereafter use those instructions to direct server or client logic, as understood in the art, to embody aspects of the invention. One type of logical apparatus that may embody the invention is a computer system as illustrated in 700, containing CPU 707, optional input devices 709 and 711, disk drives 715 and optional monitor 705. Fixed media 717, or fixed media 722 over port 719, may be used to program such a system and may represent a disk-type optical or magnetic media, magnetic tape, solid state dynamic or static memory, etc. In specific embodiments, the invention may be embodied in whole or in part as software recorded on this fixed media. Communication port 719 may also be used to initially receive instructions that are used to program such a system and may represent any type of communication connection.

The invention also may be embodied in whole or in part within the circuitry of an application specific integrated circuit (ASIC) or a programmable logic device (PLD). In such a case, the invention may be embodied in a computer understandable descriptor language, which may be used to create an ASIC, or PLD that operates as herein described.

Other Embodiments

The invention has now been described with reference to specific embodiments. Other embodiments will be apparent to those of skill in the art. In particular, a user digital information appliance has generally been illustrated as a personal computer. However, the digital computing device is meant to be any information appliance for interacting with a remote data application, and could include such devices as a digitally enabled television, cell phone, personal digital assistant, laboratory or manufacturing equipment, etc. It is understood that the examples and embodiments described herein are for illustrative purposes and that various modifications or changes in light thereof will be suggested by the teachings herein to persons skilled in the art and are to be included within the spirit and purview of this application and scope of the claims.

Furthermore, various different actions can be used to effect a gaming transaction. For example, a voice command may be spoken by the purchaser, a key may be depressed by the purchaser, a button on a client-side scientific device may be depressed by the user, or selection using any pointing device may be effected by the user.

All publications, patents, and patent applications cited herein or filed with this application, including any references filed as part of an Information Disclosure Statement, are incorporated by reference in their entirety.

What is claimed is:

1. A system for tracking one or more of movement, betting, play, or unique identity of gaming cards at a table using an intelligent card holder, where the intelligent card holder comprises:

a holding compartment in said holder for receiving and holding gaming cards;

a dispensing opening in said holder for distributing or dealing gaming cards;

a plurality of electronically readable and writeable gaming cards;

an electronic control system in said holder for interfacing with electronic components and receiving, analyzing, and storing data;

at least one electronic component in said holder for reading one or more of movement, betting play, or unique identity data from said gaming cards;

at least one electronic component in said holder for writing one or more of movement, betting, play, or unique identity data to said gaming cards; and further wherein data written via the at least one electronic component for writing to at least one of said gaming cards comprise one or more of:

a unique identity of said at least one of said gaming cards, said unique identity distinguishing said card from other cards having the same suite and value;

identity of a game participant dealt said card;

game play history of said card;

running total of all cards dealt to a hand receiving said card;

game play location of said card detected on said table; and betting amount at said table related to play of said card.

2. The system as recited in claim 1 wherein said holder is a hand held holder.

3. The system as recited in claim 1 wherein said holder is a table card holder that generally is not hand held during game play.

4. The system as recited in claim 1 further wherein said system electronically reads and writes one or more of movement, betting, play, or unique identity data to gaming chips and gaming cards.

5. The system as recited in claim 2 wherein said hand held holder is a holder able to read and write data to gaming pieces without need of other antenna or electronic components at a gaming table.

6. The system as recited in claim 1 wherein said holder contains at least two interfaces for communicating with one or more of game pieces, a gaming table, and other electronic components, said two interfaces being two different types of interfaces selected from the group:

an optical scanning interface able to detect visible or invisible reflected light from gaming cards;

an RF interface able to perform one or more of reading, writing, sending, and receiving data wirelessly from gaming cards;

a magnetic head interface able to read or write data or both read and write data to gaming cards that included embedded magnetic particles; and further wherein said data comprises one or more of movement, betting, play, or unique gaming card identity data.

7. The system as recited in claim 1 wherein said holder scans cards that are adjacent or proximate to said holder and can thereby determine a particular player or player betting area of both associated with a card during game play.

8. The system as recited in claim 1 further comprising:

an electronic control system for interfacing and controlling an interface at said holder, and for processing information received by said interface when scanning gaming cards during one or more of:

a card game;

position or status or both of cards at a player's gaming area;

position or status or both of cards at a dealer's gaming area;

position or status or both of cards at a game table discard area;

position or status or both of cards at an optional or additional gaming area that is activated before or during or both game play;

a memory maintaining a running inventory of all of the gaming cards at a table, by value and by location, said memory operatively connected with said electronic control system; and further wherein said holder scans cards that are adjacent or proximate to said holder and can thereby determine a particular player or player betting area or both associated with a card during game play;

further wherein said electronic control system is capable of maintaining a running inventory of all of the gaming cards at a table, by value and by location, and is further capable of identifying and invalidating counterfeit and unauthorized gaming cards;

further wherein the electronic control system is capable of invalidating a gaming card not found in a location indicated by a transaction history of the card;

further wherein if gaming cards are removed in an unauthorized fashion from a gaming table such removal is sensed by a table sensor and or a related camera monitoring systems;

further comprising a camera and means responsive to a particular signal from one of said tracking and monitoring components within said system for actuating existing casino monitoring systems;

further wherein said holder has a two way data interface with playing cards and two or more components selected from the group consisting of: card dealers; game operators; card players; table displays; cameras; gaming chip storage areas; table chip bank; gaming chips betting areas; table and off table data banks; players' gaming chips; players' complimentary cards; players' credit cards; players' identification cards.

9. The system as recited in claim 1 wherein each movement of a gaming card between locations on a gaming table is recorded as the card's transactional history, and said electronic control system is capable of identifying a gaming card which is not in a location indicated by the transactional history for that card.

10. The system of claim 6 wherein said scanning comprises writing information onto a data bank stored on the card regarding the movement of the card from one location to another at said table, so that the card's table activity, players, dealers, activity, transactional history is maintained in said data bank.

11. The system of claim 1 further comprising:

one or more characteristics identifying players in said casino, wherein the electronic system is capable of rating a particular player's performance based upon data obtained from tracking the gaming cards and related electronic components and optical patterns on gaming tables and interfacing with casino camera monitoring systems.

12. A method for tracking one or more of movement, betting, play, or unique identity of gaming cards at a table using an intelligent card holding device comprising:

placing a plurality of electronically readable and writeable gaming cards into a holding compartment in said holding device;

dispensing a plurality of electronically readable and writeable gaming cards from said holding device;

writing one or more of card movement, betting, game play, or card unique identity data to gaming cards using said holder while dispensing said cards;

reading one or more of card movement, betting, game play, or card unique identity data from gaming cards using said holder;

storing one or more of card movement, betting, game play, or card unique identity data by said holder to a data store; and wherein data written to at least one of said gaming cards comprise one or more of:

a unique identity of said at least one card, said unique identity distinguishing said card from other cards having the same suite and value from other decks of cards;

identity of a game participant dealt said card;
game play history of said card;
running total of all cards dealt to a hand receiving said card;
game play location of said card detected on said table; and
betting amount at said table related to play of said card.

13. The method of claim 12 further comprising:
said holding device electronically reading and writing one or more of movement, betting, play, or unique identity data to gaming chips and gaming cards.

14. The method of claim 12 further comprising:
said holding device using at least two interfaces for communicating with one or more of game pieces, a gaming table, and other electronic components, said two interfaces being two different types of interfaces selected from the group:
an optical scanning interface able to detect visible or invisible reflected light from gaming cards;
an RF interface able to perform one or more of reading, writing, sending, and receiving data wirelessly from gaming cards;
a magnetic head interface able to read or write data or both read and write data to gaming cards that included embedded magnetic particles; and further wherein said data comprises one or more of movement, betting, play, or unique gaming card identity data.

15. The method of claim 12 further comprising:
said holding device scanning cards that are adjacent or proximate to said holder to thereby determine a particular player or player betting area of both associated with a card during game play.

16. The method of claim 12 further comprising:
scanning gaming cards during one or more of:
a card game;
position or status or both of cards at a player's gaming area;
position or status or both of cards at a dealer's gaming area;
position or status or both of cards at a game table discard area;
position or status or both of cards at an optional or additional gaming area that is activated before or during or both game play.

17. The method of claim 12 further comprising:
maintaining a running inventory of all of the gaming cards at a table, by value and by location, stored in a memory operatively connected with said holding device;
said holder scanning cards that are adjacent or proximate to said holder and can thereby determine a particular player or player betting area or both associated with a card during game play.

18. The method of claim 12 further comprising:
said holding device of identifying and invalidating counterfeit and unauthorized gaming cards such as a gaming card not found in a location indicated by a transactional history stored on the card.

* * * * *